US008437671B2

(12) United States Patent
Miyakawa et al.

(10) Patent No.: US 8,437,671 B2
(45) Date of Patent: May 7, 2013

(54) IMAGE FORMING APPARATUS, IMAGE FORMING METHOD FOR IMAGE FORMING APPARATUS, AND COMPUTER PROGRAM PRODUCT

(75) Inventors: Takahiro Miyakawa, Kanagawa (JP); Shigeyuki Ishii, Kanagawa (JP); Jun Kosako, Kanagawa (JP); Takashi Enami, Kanagawa (JP); Nobuyuki Kobayashi, Kanagawa (JP); Natsuko Kawase, Kanagawa (JP); Takahiro Kamekura, Kanagawa (JP); Miyo Taniguchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 157 days.

(21) Appl. No.: 12/784,921

(22) Filed: May 21, 2010

(65) Prior Publication Data

US 2010/0303487 A1 Dec. 2, 2010

(30) Foreign Application Priority Data

Jun. 2, 2009 (JP) ..... 2009-133262

(51) Int. Cl.
*G03G 15/16* (2006.01)
*G03G 15/14* (2006.01)
*G03G 15/00* (2006.01)

(52) U.S. Cl.
USPC ..... 399/316; 399/395; 399/400

(58) Field of Classification Search ..... 399/316, 399/395, 400
See application file for complete search history.

(56) References Cited

FOREIGN PATENT DOCUMENTS

| | | | | |
|---|---|---|---|---|
| JP | 56070581 | A | * | 6/1981 |
| JP | 05107964 | A | * | 4/1993 |
| JP | 10048982 | A | * | 2/1998 |
| JP | 2000-221750 | | | 8/2000 |
| JP | 2001022205 | A | * | 1/2001 |
| JP | 2001-175091 | | | 6/2001 |
| JP | 2004-205943 | | | 7/2004 |
| JP | 2004191398 | A | * | 7/2004 |
| JP | 2008-90092 | | | 4/2008 |

OTHER PUBLICATIONS

Goto (JP 10-048982 A, Feb. 1998) JPO Machine Translation; Mikita (JP 2004-191398 A, Jul. 2004) JPO Machine Translation; Oda (JP 2001-022205 A, Jan. 2001) JPO Machine Translation; Yonetani (JP 05-107964 A, Apr. 1993) JPO Machine Translation.*
U.S. Appl. No. 12/787,836, filed May 26, 2010, Ishii, et al.

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

An image forming apparatus includes a first image forming unit that directly transfers an image onto a transfer sheet; an intermediate transfer member onto which an image is transferred; a secondary image forming unit that transfers an image onto the intermediate transfer member; a secondary transfer unit that transfers the image on the intermediate transfer member onto the transfer sheet; a fixing unit that fixes an image on the transfer sheet at a fixation position; and a guide member that guides the transfer sheet to the fixation position.

16 Claims, 11 Drawing Sheets

IMAGE FORMING APPARATUS, IMAGE FORMING METHOD FOR IMAGE FORMING APPARATUS, AND COMPUTER PROGRAM PRODUCT

CROSS-REFERENCE TO RELATED APPLICATIONS

The present application claims priority to and incorporates by reference the entire contents of Japanese Patent Application No. 2009-133262 filed in Japan on Jun. 2, 2009.

BACKGROUND OF THE INVENTION

1. Field of the Invention

The present invention relates to an image forming apparatus, an image forming method executed in the image forming apparatus, and a computer program product.

2. Description of the Related Art

In recent years, in the field of full-color image forming apparatuses employing electrophotographic methods, there has been proposed a technology related to a full-color image forming apparatus in which a direct transfer mechanism and an indirect transfer mechanism are employed in combination to transfer black transferred by the direct transfer mechanism and to transfer magenta, cyan, and yellow by the indirect transfer mechanism (see Japanese Patent Application Laid-open No. 2008-090092).

However, in the invention disclosed in Japanese Patent Application Laid-open No. 2008-090092 described above, there is a problem in that images being transferred onto a transfer sheet transferred by the indirect transfer mechanism may be misaligned because of impact of shock jitter that occurs when the transfer sheet enters a fixing device, resulting in color shift with respect to an image that has already been transferred onto the transfer sheet by the direct transfer mechanism.

The present invention is made in view of the above, and an object of the present invention is to provide an image forming apparatus, an image forming method executed in the image forming apparatus, and a computer program product that are able to prevent color shift between an image transferred onto a transfer sheet by using the indirect transfer mechanism and an image transferred onto the transfer sheet by using the direct transfer mechanism.

SUMMARY OF THE INVENTION

It is an object of the present invention to at least partially solve the problems in the conventional technology.

According to an aspect of the present invention, there is provided an image forming apparatus including: a first image forming unit that directly transfers an image onto a transfer sheet being conveyed; an intermediate transfer member onto which an image to be additionally transferred onto the transfer sheet is transferred; a secondary image forming unit that transfers an image onto the intermediate transfer member; a secondary transfer unit that transfers the image, already transferred on the intermediate transfer member by the secondary image forming unit, onto the transfer sheet, on which the image directly transferred by the first image forming unit is transferred; a fixing unit that is provided downstream of the secondary transfer unit in a conveying direction of the transfer sheet on a conveying path of the transfer sheet, and that fixes an image formed on the transfer sheet at a fixation position where the fixing unit comes into contact with the transfer sheet and applies pressure to the transfer sheet; and a guide member that guides the transfer sheet to the fixation position on a path where the transfer sheet is conveyed from the secondary transfer unit to the fixation position.

According to another aspect of the present invention, there is provided an image forming method executed in an image forming apparatus that includes a first image forming unit that directly transfers an image onto a transfer sheet being conveyed; an intermediate transfer member onto which an image to be additionally transferred onto the transfer sheet is transferred; a secondary image forming unit that transfers an image onto the intermediate transfer member; a secondary transfer unit that transfers the image, already transferred on the intermediate transfer member by the secondary image forming unit, onto the transfer sheet, on which the image directly transferred by the first image forming unit is transferred; a fixing unit that is provided downstream of the secondary transfer unit in a conveying direction of the transfer sheet on a conveying path of the transfer sheet, and that fixes an image formed on the transfer sheet at a fixation position where the fixing unit comes into contact with the transfer sheet and applies pressure to the transfer sheet; and a guide member that guides the transfer sheet to the fixation position on a path where the transfer sheet is conveyed from the secondary transfer unit to the fixation position, that has a contact surface to be in contact with the transfer sheet on the path where the transfer sheet is conveyed from the secondary transfer unit to the fixation position, and that is configured to be able to change an angle between the transfer sheet and the contact surface, the image forming method including: performing, by a control unit of the image forming apparatus, control to change the angle depending on a predetermined condition that changes a way of skew of the transfer sheet that has passed through the secondary transfer unit and a moving direction of the transfer sheet after the transfer sheet comes into contact with the contact surface.

According to still another aspect of the present invention, there is provided a computer program product including a computer usable medium having computer-readable program codes embodied in the medium for controlling an image forming apparatus that includes a first image forming unit that directly transfers an image onto a transfer sheet being conveyed; an intermediate transfer member onto which an image to be additionally transferred onto the transfer sheet is transferred; a secondary image forming unit that transfers an image onto the intermediate transfer member; a secondary transfer unit that transfers the image already transferred on the intermediate transfer member by the secondary image forming unit, onto the transfer sheet, on which the image directly transferred by the first image forming unit is transferred; a fixing unit that is provided downstream of the secondary transfer unit in a conveying direction of the transfer sheet on a conveying path of the transfer sheet, and that fixes an image formed on the transfer sheet at a fixation position where the fixing unit comes into contact with the transfer sheet and applies pressure to the transfer sheet; and a guide member that guides the transfer sheet to the fixation position on a path where the transfer sheet is conveyed from the secondary transfer unit to the fixation position, that has a contact surface to be in contact with the transfer sheet on the path where the transfer sheet is conveyed from the secondary transfer unit to the fixation position, and that is configured to be able to change an angle between the transfer sheet and the contact surface, the program codes when executed causing a computer to execute: performing, by a control unit of the image forming apparatus, control to change the angle based on a predetermined condition that changes a way of skew of the transfer sheet that has passed through the secondary transfer unit and a moving direction of the transfer sheet after the transfer sheet comes into contact with the contact surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiment of an image forming apparatus, an image forming method executed in the image forming apparatus, and a computer program product according to the present invention will be explained in detail below with reference to the accompanying drawings.

An embodiment of the present invention will be described with reference to FIGS. 1 to 17. The present embodiment is one example in which a color digital multifunction peripheral as a so-called MFP (Multi Function Peripheral) having a copier function, a facsimile (FAX) function, a printer function, a scanner function, and an input-image distribution function (for distributing original images read by the scanner function and images input by the printer function and the FAX function) combined together is applied to an image forming apparatus. The present embodiment is described using an example in which the image forming apparatus, the image forming method executed in the image forming apparatus, and the computer program product according to the present invention are applied to the color digital MFP. However, the present invention can be applied to any image forming apparatuses such as copiers, printers, scanner devices, and FAX machines.

Figure 1:
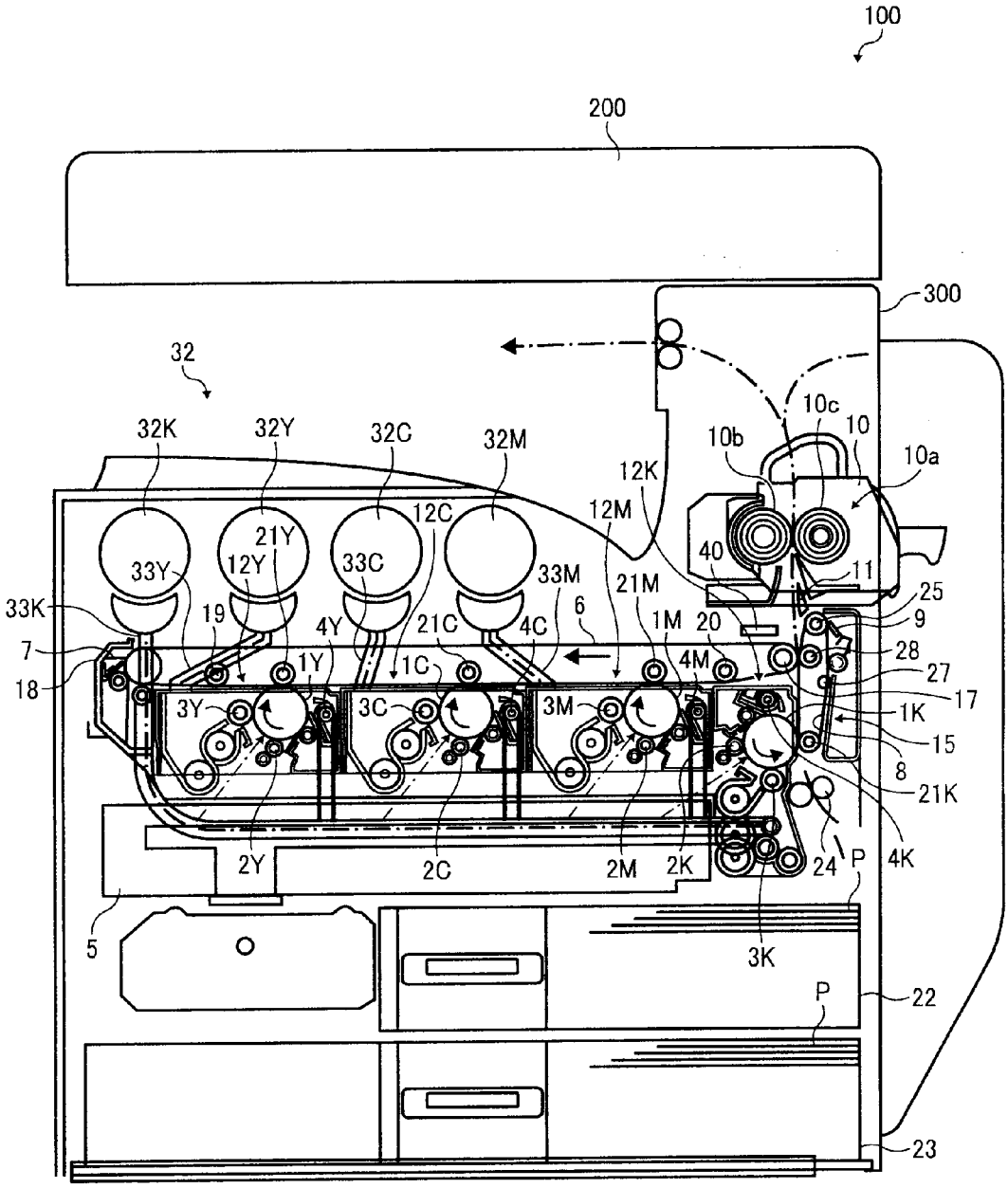
FIG. 1 is a general configuration diagram of a color digital multifunction peripheral according to an embodiment of the present invention.

FIG. 1 is a general configuration diagram of a color digital MFP according to the embodiment of the present invention. As illustrated in FIG. 1, a color digital MFP 100 includes a scanner unit 200 as an image reading device and a printer unit 300 as an image printing device. The scanner unit 200 and the printer unit 300 constitute an engine control unit 500 (see FIG. 10). The color digital MFP 100 of the embodiment can select a function from among a document box function, a copier function, a printer function, and a FAX function by sequentially switching the functions from one to the other via an application switch key of an operation unit 400 (see FIG. 10). The color digital MFP 100 enters into a document box mode when the document box function is selected, and enters into a FAX mode when the FAX function is selected.

The printer unit 300 having functions specific to the color digital MFP 100 of the embodiment is described in detail below. The printer unit 300 of the color digital MFP 100 includes an image forming unit 12K for black (K) provided independently. The image forming unit 12K (first image forming unit) for black (K) is arranged so that a toner image formed by the image forming unit 12K for black can directly be transferred onto a transfer sheet P being conveyed. More specifically, the image forming unit 12K for black is independent from a transfer configuration for Y, C, and M in which an intermediate transfer belt 6 to be described later is used. And a black (K) toner image formed by the image forming unit 12K is directly transferred onto the transfer sheet P by a secondary transfer unit 15 different from the intermediate transfer belt 6.

The intermediate transfer belt 6 (intermediate transfer member) is in the form of a loop extended substantially horizontally, and onto which a toner image, which is to be additionally transferred onto the transfer sheet P bearing the toner image directly transferred from the image forming unit 12K for black, is transferred. In the embodiment, the intermediate transfer belt 6 is supported by a driving roller 17, a driven roller 18, and tension rollers 19 and 20. A cleaning unit 7 that removes toner remained on the intermediate transfer belt 6 is arranged on the outer side of the intermediate transfer belt 6 so as to face the driven roller 18.

Furthermore, as illustrated in FIG. 1, the printer unit 300 of the color digital MFP 100 is a tandem type in which three image forming units 12Y, 12C, and 12M (second image forming units), which transfer toner images for yellow, cyan, and magenta (hereinafter, abbreviated as Y, C, and M, respectively) respectively onto the intermediate transfer belt 6, are arranged in series in a belt moving direction along the intermediate transfer belt 6 being the intermediate transfer member in the form of a loop substantially extended horizontally.

Each of the image forming units 12Y, 12C, 12M, and 12K is configured as a process cartridge detachably attached to a body of the printer unit 300. Each image forming unit 12 (12Y, 12C, 12M, and 12K) includes a photosensitive element 1 (1Y, 1C, 1M, and 1K) as an image carrier, a charging device 2 (2Y, 2C, 2M, and 2K), a developing device 3 (3Y, 3C, 3M, and 3K) that supplies toner onto a latent image to form a toner image, a cleaning device 4 (4Y, 4C, 4M, and 4K), and the like. In each of the image forming units 12Y, 12C, and 12M, each of the photosensitive elements 1Y, 1C, and 1M is arranged so as to come into contact with a bottom extended surface of the intermediate transfer belt 6. On the inner side of the intermediate transfer belt 6, primary transfer rollers 21Y, 21C, and 21M as primary transfer means are arranged to face the photosensitive elements 1Y, 1C, and 1M, respectively.

The printer unit 300 of the color digital MFP 100 also includes an exposing device 5 that causes an LD (Laser Diode) not illustrated to emit laser beam and that is provided for each image forming unit 12 (12Y, 12C, 12M, and 12K) for each color. An original that is read by the scanner unit 200, received data such as a FAX, color image information transmitted from a computer, and the like are separated into color components of yellow, cyan, magenta, and black, so that data for each color plate is generated and is sent to the exposing device 5 of each image forming unit 12 (12Y, 12C, 12M, and 12K) for each color. With the laser beam emitted from the LD of the exposing device 5, an electrostatic latent image is formed on each photosensitive element 1 (1Y, 1C, 1M, and 1K) of each image forming unit 12 (12Y, 12C, 12M, and 12K).

In the embodiment, a blade-type cleaning device is used as the cleaning device 4; however, the present invention is not limited to this example. For example, a fur-brush roller and a magnetic brush cleaning system can be employed. Furthermore, the exposing device 5 is not limited to a laser-type exposing device. For example, a system using an LED (Light Emitting Diode) may be employed.

The printer unit 300 of the color digital MFP 100 also includes pattern detection sensors 40 for detecting position-adjustment control patterns PT to be detected of the amount of skew in LD scanning, not illustrated, at respective positions on the left edge, in the center, and on the right edge of the intermediate transfer belt 6 in a width direction.

For example, when reflective optical sensors (specular reflection sensors) are used as the pattern detection sensors 40, the pattern detection sensors 40 project light to the intermediate transfer belt 6 and detect the position-adjustment control patterns PT formed on the intermediate transfer belt 6 and reflected light from the intermediate transfer belt 6 to thereby acquire information for measuring the amount of positional shift. A position-adjustment control function is able to measure skew with respect to a reference color (in this embodiment, one of Y, C, and M), shift in sub-scanning registration, shift in main-scanning registration, and a main-scanning magnification error. In actual reading, edges of the position-adjustment control patterns PT are read.

In the embodiment, the specular reflection sensors are applied to the pattern detection sensors 40; however, the present invention is not limited to this example. For example, a diffused-light sensor unit that reads the position-adjustment control patterns PT (see FIG. 13) and light diffused by the intermediate transfer belt 6 may be employed.

The printer unit 300 of the color digital MFP 100 is arranged so as to substantially vertically intersect with the intermediate transfer belt 6 extended substantially horizontally, and includes the secondary transfer unit 15 that transfers toner images for a plurality of colors, which have been transferred onto the intermediate transfer belt 6, onto the transfer sheet P onto which a black toner image has already been transferred. In the embodiment, the image forming unit 12K for black (K) is arranged near and along a substantially vertical conveying path of the transfer sheet P, and the secondary transfer unit 15 is arranged so as to utilize a space upstream of a fixing device 10 (to be described later) in the substantially vertical conveying path.

Figure 2:
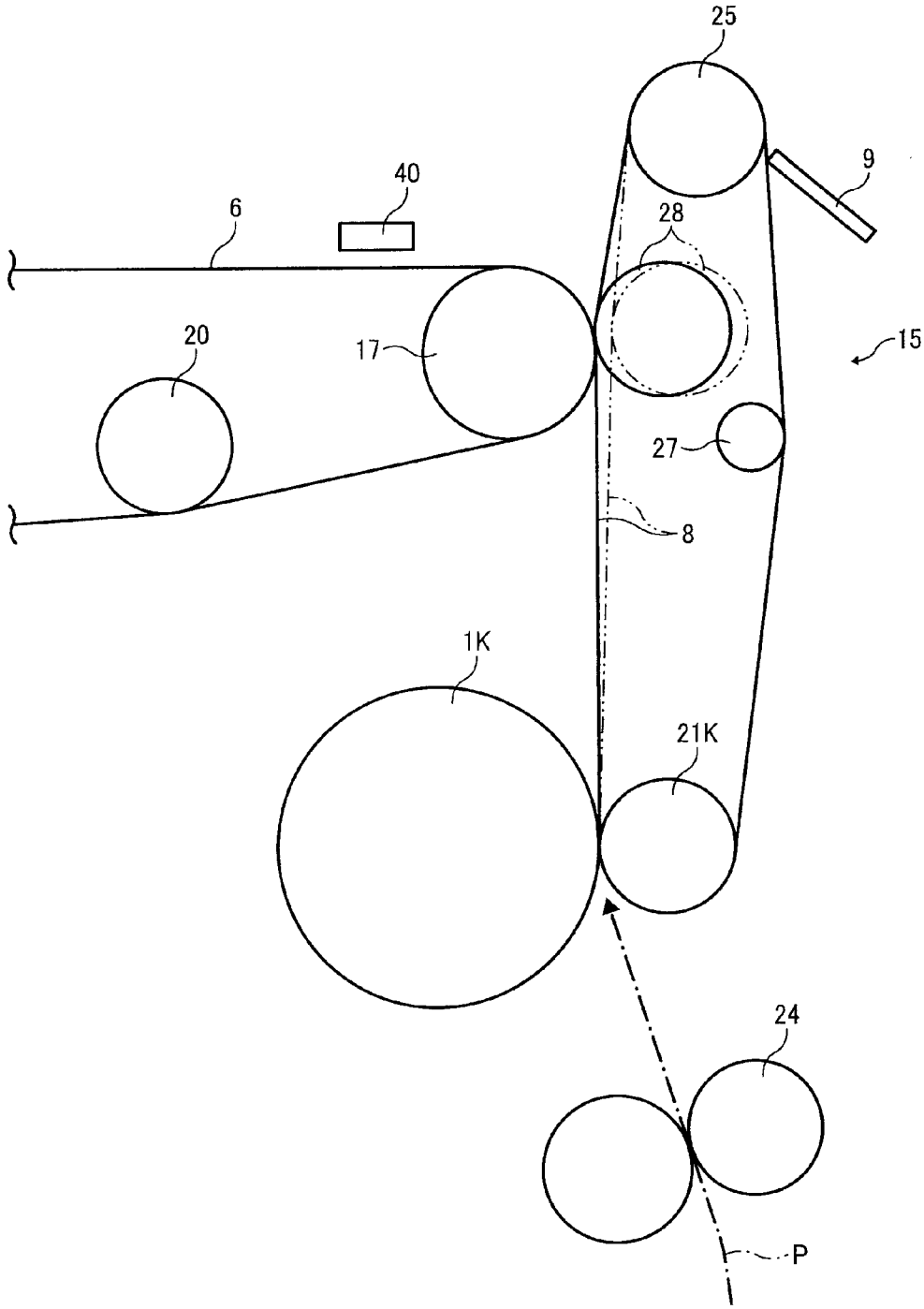
FIG. 2 is a schematic diagram of a general configuration of a secondary transfer unit.

A general configuration of the secondary transfer unit 15 is described below with reference to FIG. 2. FIG. 2 is a schematic diagram of the general configuration of the secondary transfer unit 15. As illustrated in FIG. 2, the secondary transfer unit 15 includes a transfer-sheet conveying belt 8, a driving roller 25 that supports the transfer-sheet conveying belt 8, a driven roller 21K that also functions as a transfer means, a tension roller 27, a secondary transfer roller 28 as a secondary transfer means, and a cleaning means 9 that cleans the surface of the transfer-sheet conveying belt 8. The secondary transfer roller 28 is arranged to face the driving roller 17 of the intermediate transfer belt 6, and is able to be brought into contact with and separated from the intermediate transfer belt 6 by a contacting-separating mechanism not illustrated.

In the embodiment, the secondary transfer unit 15 is configured such that the secondary transfer roller 28 is to be displaced. However, as long as the secondary transfer unit 15 is able to be brought into contact with and separated from the intermediate transfer belt 6, the present invention is not limited to this example. For example, it is possible to displace the whole transfer-sheet conveying belt 8 by using the driven roller 21K as a fulcrum.

Conventionally, there has been proposed a configuration in which an intermediate transfer belt is separated from image carries for colors other than black when monochrome images are formed. In this system, because only the intermediate transfer belt is driven, it is not necessary to drive (idle) the image forming units for colors other than black. However, because the intermediate transfer belt is displaced, a problem with tension fluctuation inevitably occurs. In contrast, with the configuration in which the secondary transfer roller 28 is displaced and the configuration in which the whole transfer-sheet conveying belt 8 is displaced, it is possible to maintain a position of the intermediate transfer belt 6 as it is (not interlocked with the transfer-sheet conveying belt 8), so that the tension fluctuation of the intermediate transfer belt 6 does not occur. In other words, although the configuration may be applied in which the intermediate transfer belt 6 for which a number of positions need to be adjusted is brought into contact with and separated from the transfer-sheet conveying belt 8, this configuration may lead to degradation in positional accuracy in position adjustment over time. In contrast, in the embodiment, it is possible to maintain the intermediate transfer belt 6 in contact with each photosensitive element 1 (1Y, 1C, and 1M) for Y, C, and M, so that positioning accuracy between the rollers of the intermediate transfer belt 6 can be maintained high. Therefore, allowance for belt deflection can be improved. Furthermore, belt movement is stabilized, so that allowance for positional shift (color shift) at the time of full color image formation can be improved.

It is also possible to employ the configuration in which the driving roller 17 that supports the intermediate transfer belt 6 is displaced by a means not illustrated, so that the intermediate transfer belt 6 is brought into contact with and separated from the transfer-sheet conveying belt 8. In this case, because a conveying posture for the transfer sheet P is not displaced, behavior of the transfer sheet P between the transfer-sheet conveying belt 8 and the fixing device 10 (to be described later) can hardly become unstable. Therefore, it is possible to prevent occurrence of crease or image disturbance on the transfer sheet P discharged from the fixing device 10. It is also possible to employ the configuration in which both the secondary transfer roller 28 of the secondary transfer unit 15 and the driving roller 17 that supports the intermediate transfer belt 6 are moved so that the intermediate transfer belt 6 is brought into contact with and separated from the transfer-sheet conveying belt 8.

Referring back to FIG. 1, the printer unit 300 of the color digital MFP 100 is arranged in a space which is present downstream of the secondary transfer unit 15 in the transfer-sheet conveying direction on the conveying path of the transfer sheet P to be conveyed substantially vertically from the secondary transfer unit 15. The printer unit 300 includes the fixing device 10 that fixes an image formed on the transfer sheet P at a nip portion (a fixation position to be in contact with the transfer sheet P and at which pressure is applied) between a fixing roller pair 10*a* including a heating roller 10*b* and a pressing roller 10*c* being in pressure contact with each other.

The printer unit 300 of the color digital MFP 100 also includes a guide member 11 that guides the transfer sheet P, onto which a YCM toner image is transferred in the secondary transfer unit 15, to the nip portion of the fixing roller pair 10*a* on a path where the transfer sheet P is conveyed substantially vertically from the secondary transfer unit 15, reaching the nip portion of the fixing roller pair 10*a*.

Figure 3:
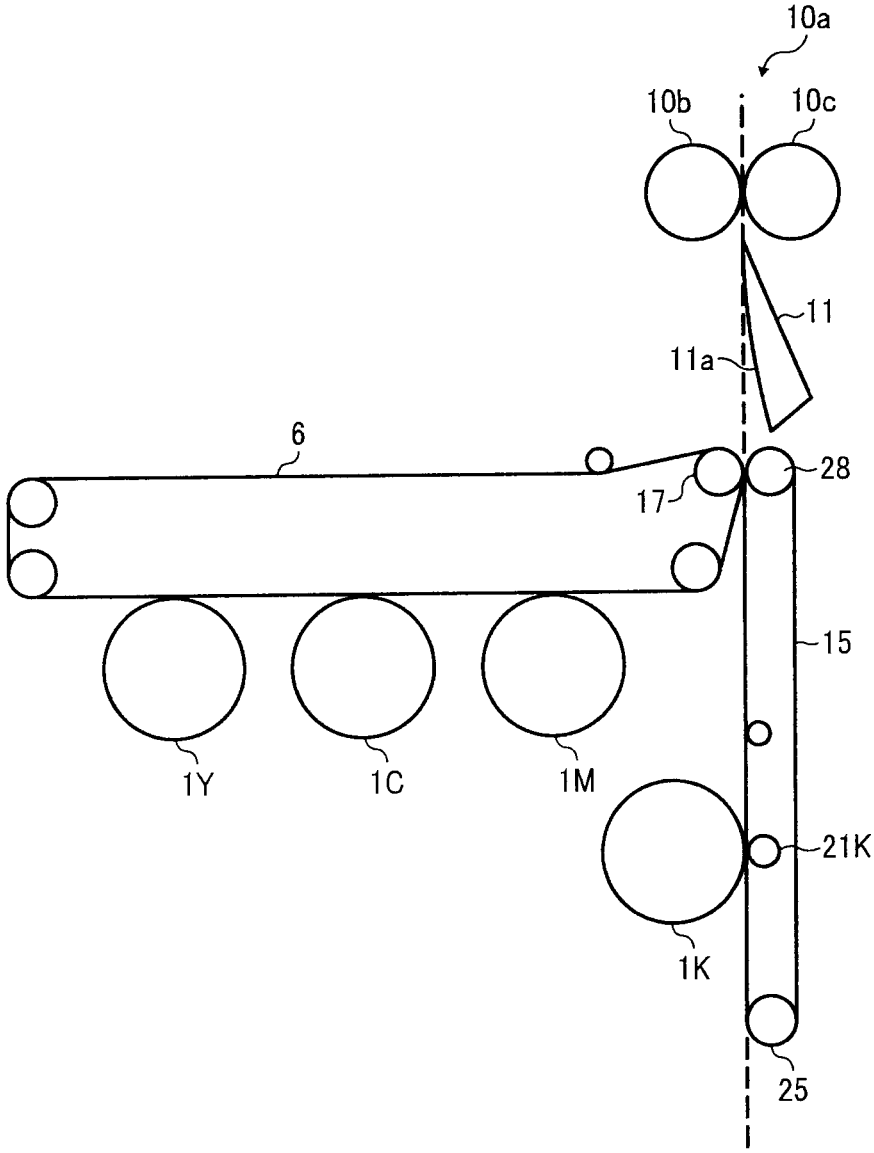
FIG. 3 is a schematic diagram of a general configuration of a guide member.
Figure 4:
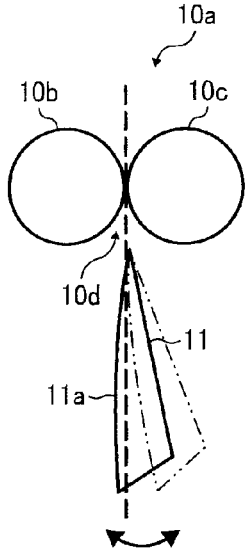
FIG. 4 is a schematic diagram of the general configuration of the guide member.

With reference to FIGS. 3 to 6, a general configuration of the guide member 11 is described. FIGS. 3 to 6 are schematic diagrams of the general configuration of the guide member. As illustrated in FIGS. 3 and 4, the guide member 11 has a contact surface 11*a* to be in contact with the transfer sheet P on the path where the transfer sheet P is conveyed substantially vertically from the secondary transfer unit 15 to reach a nip portion 10*d* of the fixing roller pair 10*a*, and is arranged so that an angle between the transfer sheet P and the contact surface 11*a* can be changed. More specifically, the guide member 11 moves in a direction indicated by an arrow of FIG. 4 about a rotation axis 11*b* piercing through the guide member 11 near an edge on the side where the fixing device 10 is arranged. Accordingly, the guide member 11 can change the angle between the transfer sheet P and the contact surface 11*a*. The rotation axis 11*b* is connected to a DC motor 14 and rotates in a direction indicated by an arrow in FIG. 6 along with a rotation drive of the DC motor 14.

In the embodiment, the guide member 11 is adopted which has the contact surface 11*a* arranged on the conveying path of the transfer sheet P to be conveyed substantially vertically from the secondary transfer unit 15. However, the present invention is not limited to this, and it is possible to employ any members that can guide the transfer sheet P to the nip portion 10*d* of the fixing roller pair 10*a*, through the path where the transfer sheet P, onto which the YCM toner image has been transferred by the secondary transfer unit 15, is conveyed from the secondary transfer unit 15 to the nip portion 10*d* of the fixing roller pair 10*a*.

The printer unit 300 of the color digital MFP 100 also includes a homing sensor 13 that detects a home position (HP) of the guide member 11 as a position to be a basis for changing the angle between the transfer sheet P and the contact surface 11*a*.

Figure 7:
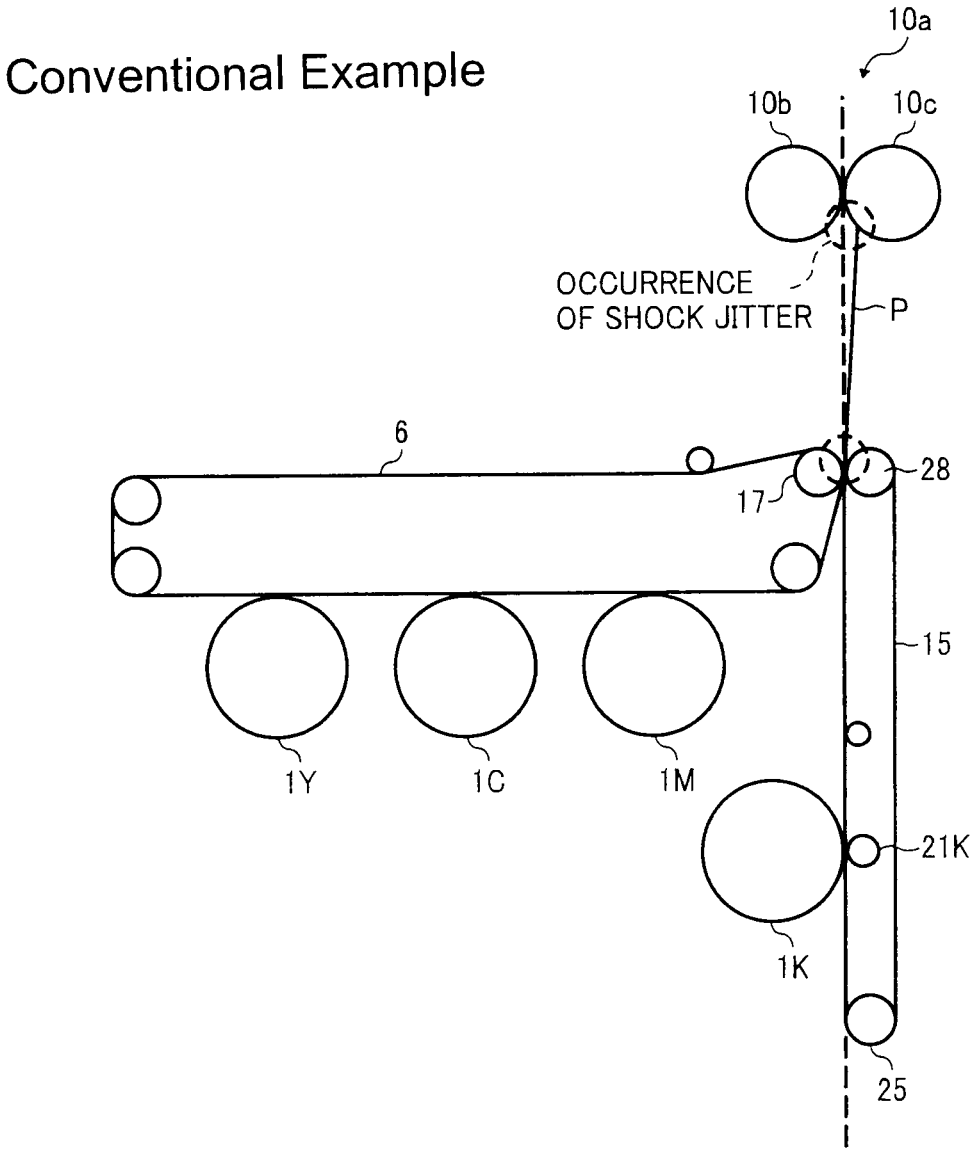
FIG. 7 is a diagram for explaining a conventional problem that occurs when a transfer sheet is conveyed from the secondary transfer unit to a fixing device.
Figure 8:
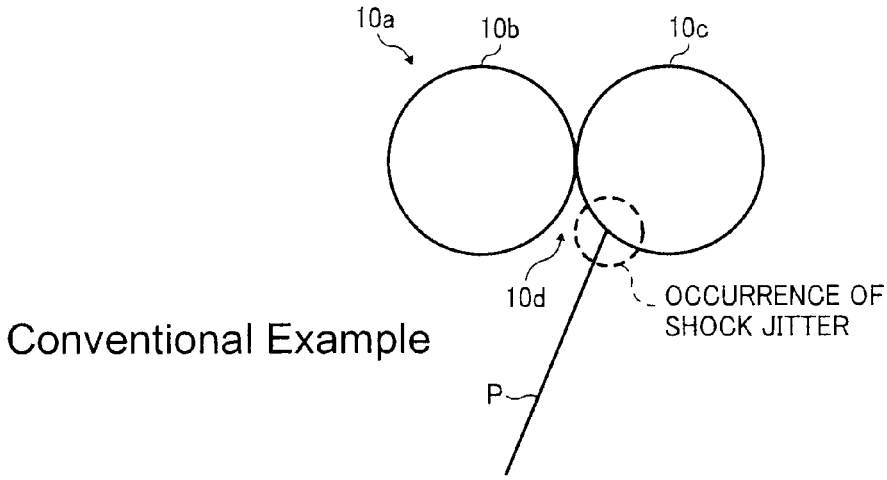
FIG. 8 is a diagram for explaining the conventional problem that occurs when a transfer sheet is conveyed from the secondary transfer unit to the fixing device.
Figure 9:
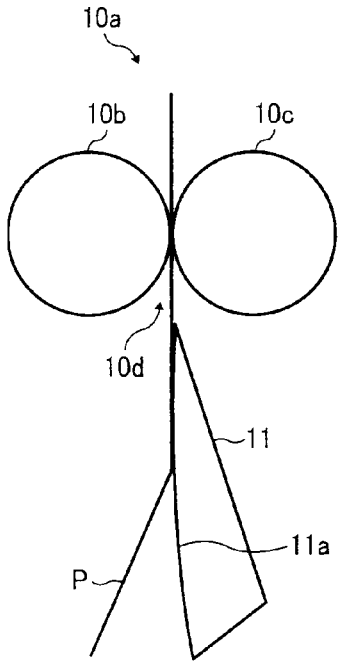
FIG. 9 is a diagram for explaining a function of the guide member.

With reference to FIGS. 7 to 9, conventional problems that occur when the transfer sheet P is conveyed from the secondary transfer unit 15 to the fixing device 1C, and functions of the guide member 11 are described. FIGS. 7 and 8 are diagrams for explaining the conventional problems that occur when a transfer sheet is conveyed from the secondary transfer unit to the fixing device. FIG. 9 is a diagram for explaining the functions of the guide member.

Conventionally, as illustrated in FIGS. 7 and 8, when the transfer sheet P, onto which the YCM toner image is transferred by the secondary transfer unit 15, arrives at the nip portion 10*d*, and if the transfer sheet P is shifted with respect to the nip portion 10*d* of the fixing roller pair 10*a*, the transfer sheet P abuts to the pressing roller 10*c* (or the heating roller 10*b*) once, and shock at this time (hereinafter, referred to as "shock jitter") is transmitted to the transfer sheet P. When the shock jitter is transmitted to the transfer sheet P, the YCM toner image transferred onto the transfer sheet P by the secondary transfer unit 15 (images transferred onto the intermediate transfer belt 6 by the image forming units 12Y, 12C, and 12M) is shifted with respect to a K toner image that has already been transferred (an image directly transferred onto the transfer sheet P by the image forming unit 12K).

In contrast, in the embodiment, as illustrated in FIG. 9, if the transfer sheet P is shifted with respect to the nip portion 10*d* when the transfer sheet P, onto which the YCM toner image is transferred by the secondary transfer unit 15, arrives at the nip portion 10*d*, the transfer sheet P comes into contact with the contact surface 11*a* of the guide member 11 and the transfer sheet P is guided to the nip portion 10*d*. Accordingly, the transfer sheet P can be conveyed to the fixing roller pair 10*a* without being shifted from the nip portion 10*d*. Consequently, it is possible to reduce or prevent occurrence of the shock jitter. As a result, it is possible to prevent the shift between the YCM toner image transferred onto the transfer sheet P by the secondary transfer unit 15 and the K toner image that has already been transferred onto the transfer sheet P.

Referring back to FIG. 1, sheet feed trays 22 and 23 for transfer sheets of different sizes are provided below the printer unit 300 of the color digital MFP 100. A transfer sheet P, fed by a sheet feed unit not illustrated from each of the sheet feed trays 22 and 23, is conveyed by a conveying unit not illustrated to reach a registration roller pair 24, and skew of the transfer sheet P is corrected at this position. Then, the transfer sheet P is conveyed by the registration roller pair 24 at predetermined timing to a transfer site of the photosensitive element 1K and the transfer-sheet conveying belt 8.

The printer unit 300 of the color digital MFP 100 also includes a toner bank 32 above the intermediate transfer belt 6. The toner bank 32 includes toner tanks 32K, 32Y, 32C, and 32M which are connected to the developing devices 3 (3Y, 3C, 3M, and 3K) by toner supplying pipes 33K, 33Y, 33C, and 33M, respectively. Because the image forming unit 12K for black is arranged independent of the image forming units 12 (12Y, 12C, and 12M) for YCM, reverse-transferred toner for YCM is not mixed up into a process of black image forming. Therefore, toner collected by the photosensitive element 1K is conveyed to the developing device 3K for black via a black-toner collection path not illustrated, and then reused. It is possible to provide a device that removes paper dust, a device that can switch the path to a path for discharging toner, and the like in a mid-course of the black-toner collection path.

Figure 10:
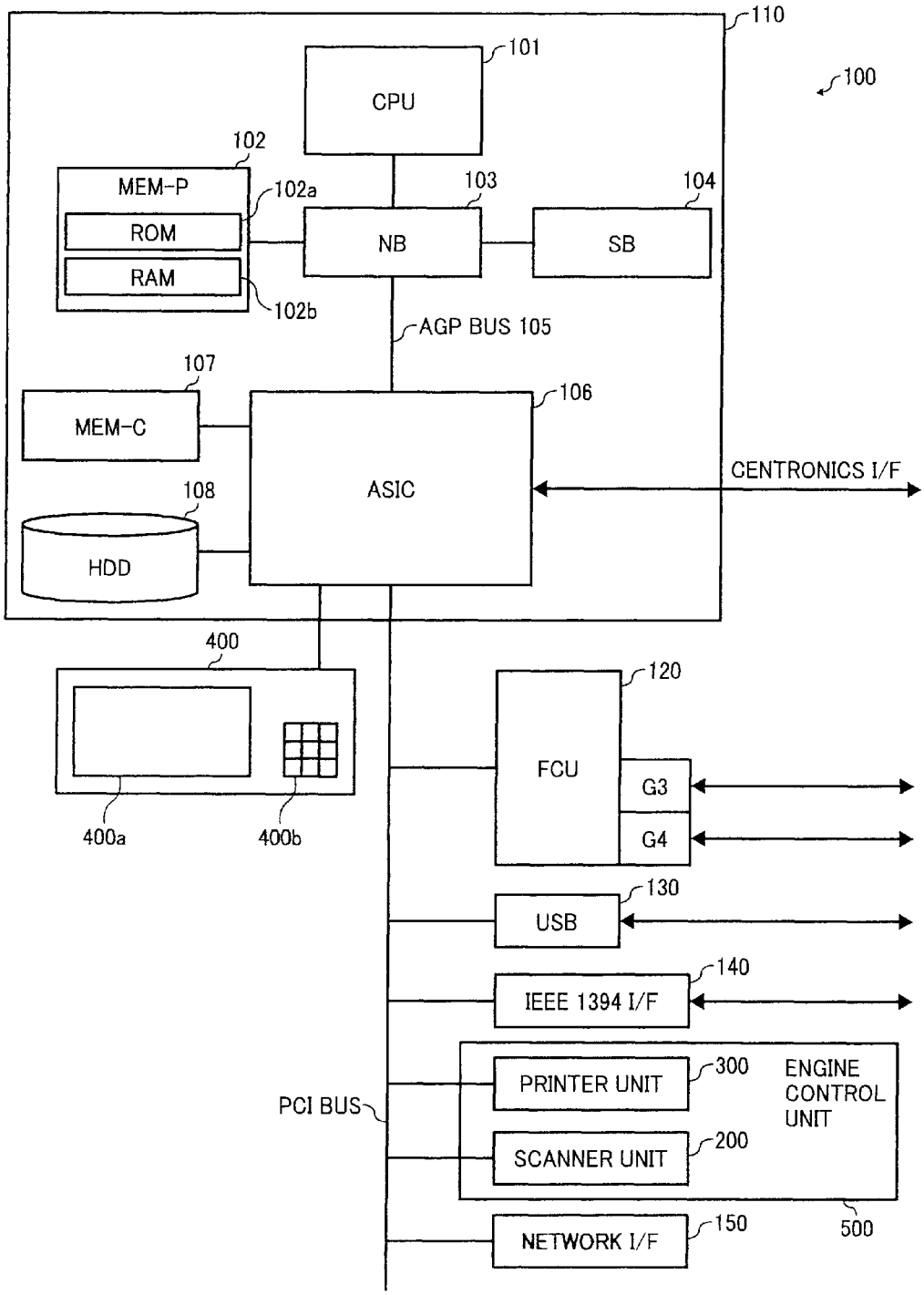
FIG. 10 is a block diagram of a hardware configuration of the color digital multifunction peripheral.

Next, a hardware configuration of the color digital MFP 100 is described with reference to FIG. 10. FIG. 10 is a block diagram of the hardware configuration of the color digital MFP. As illustrated in FIG. 1C, the color digital MFP 100 includes a controller 11C, the printer unit 300, and the scanner unit 200 connected to one another via a PCI (Peripheral Component Interconnect) bus. The controller 110 is a controller that controls the whole color digital MFP 100, drawing, communication, and inputs from the operation unit 400. The printer unit 300 and/or the scanner unit 200 include an image processing section for performing error diffusion, gamma correction, and the like. The operation unit 400 includes an operation display unit 400*a* that displays original-image information of an original read by the scanner unit 200 and the like onto an LCD (Liquid Crystal Display) and receives input from an operator via a touch panel, and a keyboard unit 400*b* that receives key inputs from the operator.

The color digital MFP 100 according to the embodiment can select a function from among the document box function, the copier function, the printer function, and the FAX function by sequentially switching the functions from one to the other via the application switch key of the operation unit 400. The color digital MFP 100 enters into a document box mode when the document box function is selected, enters into a copier mode when the copier function is selected, enters into a printer mode when the printer function is selected, and enters into a FAX mode when the FAX function is selected.

The controller 110 includes a CPU (Central Processing Unit) 101 as a main component of the computer, a system memory (MEM-P) 102, a north bridge (NB) 103, a south bridge (SB) 104, an ASIC (Application Specific Integrated Circuit) 106, a local memory (MEM-C) 107 as a storage unit, and a hard disk drive (HDD) 108 as a storage unit. The NB 103 and the ASIC 106 are connected to each other via an AGP (Accelerated Graphics Port) bus 105. The MEM-P 102 includes a ROM (Read Only Memory) 102*a* and a RAM (Random Access Memory) 102*b*.

The CPU 101 controls the whole color digital MFP 100, includes a chipset formed of the NB 103, the MEM-P 102, and the SB 104, and is connected to other apparatuses via the chipset.

The NB 103 is a bridge for connecting the CPU 101, the MEM-P 102, the SB 104, and the AGP bus 105 to one another, and includes a memory controller for controlling read and write to the MEM-P 102, a PCI master, and an AGP target.

The MEM-P 102 is a system memory used as a storage memory for storing computer programs and data, a load memory for loading computer programs and data, and a drawing memory for a printer, and includes the ROM 102*a* and the RAM 102*b*. The ROM 102*a* is a read only memory used as the storage memory for storing computer programs and data for controlling operations of the CPU 101. The RAM 102*b* is a writable and readable memory used as the load memory for loading computer programs and data and the drawing memory for a printer.

The SB 104 is a bridge for connecting the NB 103, a PCI device, and a peripheral device to one another. The SB 104 is connected to the NB 103 via the PCI bus to which a network interface (I/F) 150 is also connected.

The ASIC 106 is an IC (Integrated Circuit) used for image processing and including hardware elements for image processing, and functions as a bridge that connects the AGP bus 105, the PCI bus, the HDD 108, and the MEM-C 107 to one another. The ASIC 106 includes a PCI target, an AGP master, an arbiter (ARB) as a core of the ASIC 106, a memory controller that controls the MEM-C 107, a plurality of DMACs (Direct Memory Access Controllers) for rotating image data by using hardware logic and the like, and a PCI unit that transfers data to the printer unit 300 and the scanner unit 200 via the PCI bus. To the ASIC 106, an FCU (Fax Control Unit) 120, a USB (Universal Serial Bus) 130, an IEEE 1394 (the Institute of Electrical and Electronics Engineers 1394) I/F 140, and the network I/F 150 are connected via the PCI bus.

The MEM-C 107 is a local memory used as a copy image buffer and a code buffer. The HDD 108 is a storage for accumulating image data, computer programs for controlling the operations of the CPU 101, font data, and forms.

The AGP bus 105 is a bus I/F for a graphics accelerator card to increase a processing speed of graphics processing. The AGP bus 105 directly accesses the MEM-P 102 with a high-speed throughput, thereby allowing the graphics accelerator card to process graphics at high speed.

The computer programs executed by the color digital MFP 100 of the embodiment may be provided by being installed in the ROM and the like. The computer programs executed by the color digital MFP 100 of the embodiment may be recorded in a computer-readable recording medium such as a CD (Compact Disc)-ROM, a flexible disk (FD), a CD-R, and a DVD (Digital Versatile Disc) in an installable format or an executable format for distribution.

The computer programs executed by the color digital MFP 100 of the embodiment can be stored in a computer connected to a network such as the Internet via the network I/F 150 such that they can be downloaded via the network. Furthermore, the computer programs executed by the color digital MFP 100 of the embodiment can be provided or distributed via the network such as the Internet.

Figure 11:
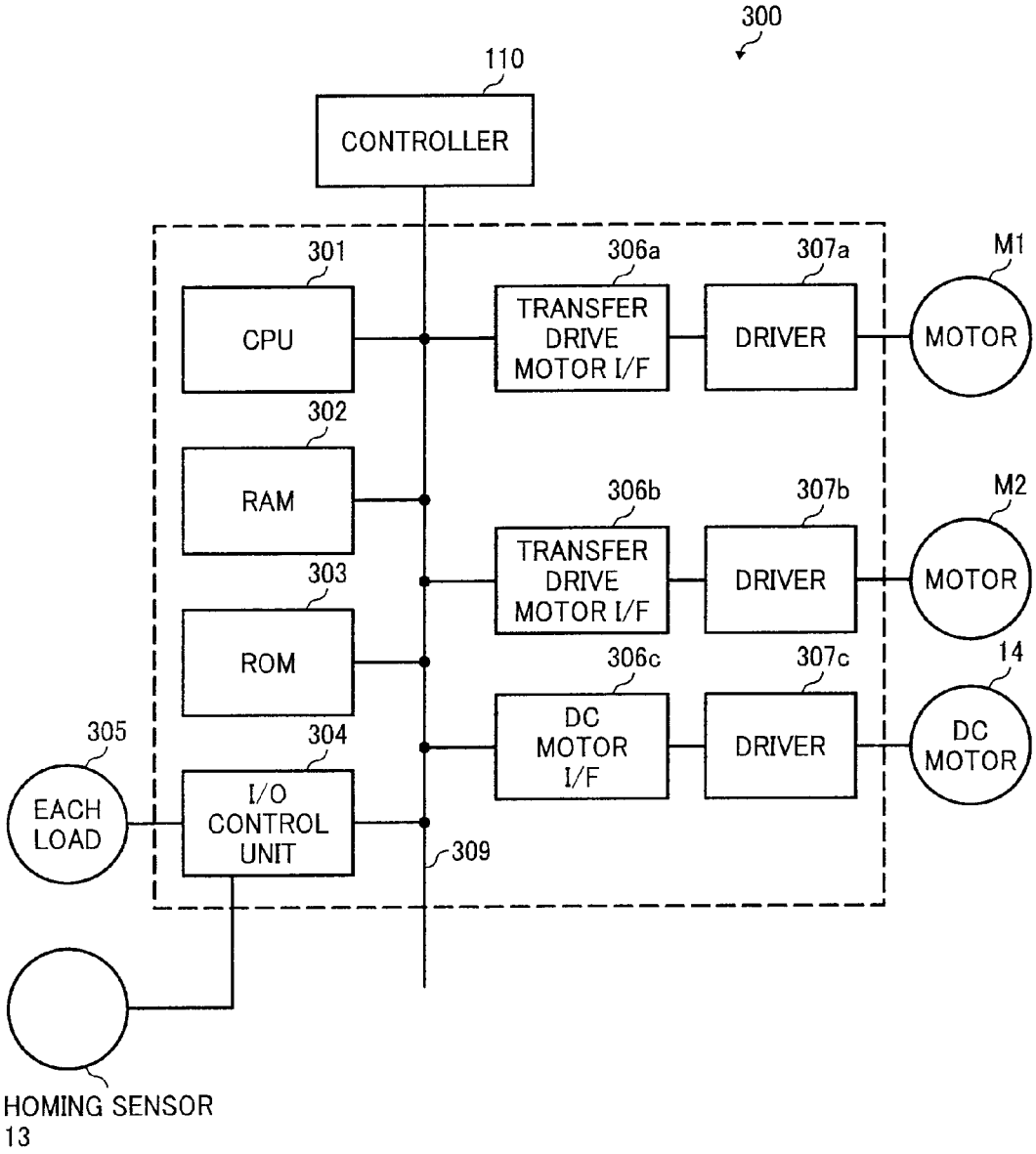
FIG. 11 is a block diagram of a hardware configuration of a printer unit.

FIG. 11 is a block diagram of a hardware configuration of the printer unit 300. As illustrated in FIG. 11, a control system of the printer unit 300 includes a CPU 301, a RAM 302, a ROM 303, an I/O control unit 304, a transfer drive motor I/F 306*a*, a driver 307*a*, a transfer drive motor I/F 306*b*, a driver 307*b*, a DC motor I/F 306*c*, and a driver 307*c*.

The CPU 301 controls the whole printer unit 300 by controlling reception of image data and transmission/reception of control commands input from the controller 110, and the like.

The RAM 302 used as a work memory, the ROM 303 for storing computer programs, and the I/O control unit 304 are connected to one another via a bus 309, and implement data read/write processing and various operations of motors, clutches, solenoids, and sensors for driving each load 305. Furthermore, the RAM 302 used as the work memory, the ROM 303 for storing computer programs, and the I/O control unit 304 execute operations for acquiring a result of detection of a home position by the homing sensor 13.

Figure 5:
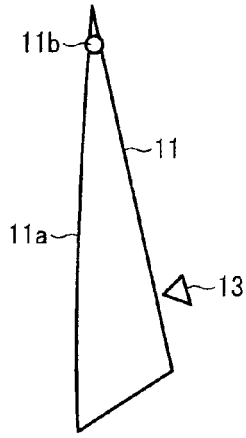
FIG. 5 is a schematic diagram of the general configuration of the guide member.
Figure 6:
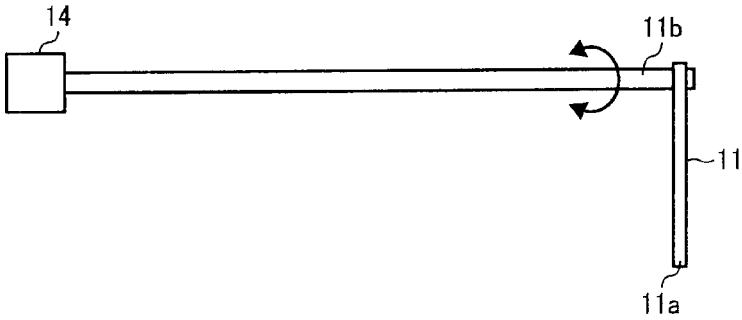
FIG. 6 is a schematic diagram of the general configuration of the guide member.

The transfer drive motor I/F 306*a* outputs a command signal to instruct a drive frequency of a drive pulse signal to the driver 307*a* according to a drive command from the CPU 301. A transfer drive motor M1 is driven to rotate according to the frequency. Due to this rotation drive, the driving roller 17 illustrated in FIG. 2 is driven to rotate. Similarly, the transfer drive motor I/F 306*b* outputs a command signal for instructing a drive frequency of a drive pulse signal to the driver 307*b* according to a drive signal from the CPU 301. A transfer drive motor M2 is driven to rotate according to the frequency. According to this rotation drive, the driving roller 25 illustrated in FIG. 2 is driven to rotate. Furthermore, the DC motor I/F 306*c* outputs a command signal for instructing a drive frequency of a drive pulse signal to the driver 307*c* according to a drive signal from the CPU 301. The DC motor 14 is driven to rotate according to the frequency. Due to this rotation drive, the rotation axis 11*b* illustrated in FIGS. 5 and 6 is driven to rotate.

The RAM 302 is used as a work area for executing the computer programs stored in the ROM 303. Because the RAM 302 is a volatile memory, parameters such as amplitude values and phase values used for next belt drive are stored in a nonvolatile memory such as an EEPROM (Electrically Erasable Programmable Read Only Memory) and data for one round of the belt is loaded on the RAM 302 by using a sine function or approximation when power is turned on or the driving roller 17 is driven.

The computer programs executed by the printer unit 300 of the embodiment are made up of modules including units to be described later (i.e., a print control unit 51, a position-adjustment control unit 52, an indirect-transfer control unit 53, a direct-transfer control unit 54, a secondary-transfer control unit 55, and a guide control unit 56 (see FIG. 12)). As actual hardware, when the CPU 301 reads and executes the computer programs from the ROM 303, the above modules are loaded, and the print control unit 51, the position-adjustment control unit 52, the indirect-transfer control unit 53, the direct-transfer control unit 54, the secondary-transfer control unit 55, and the guide control unit 56 are created on a main memory.

Figure 12:
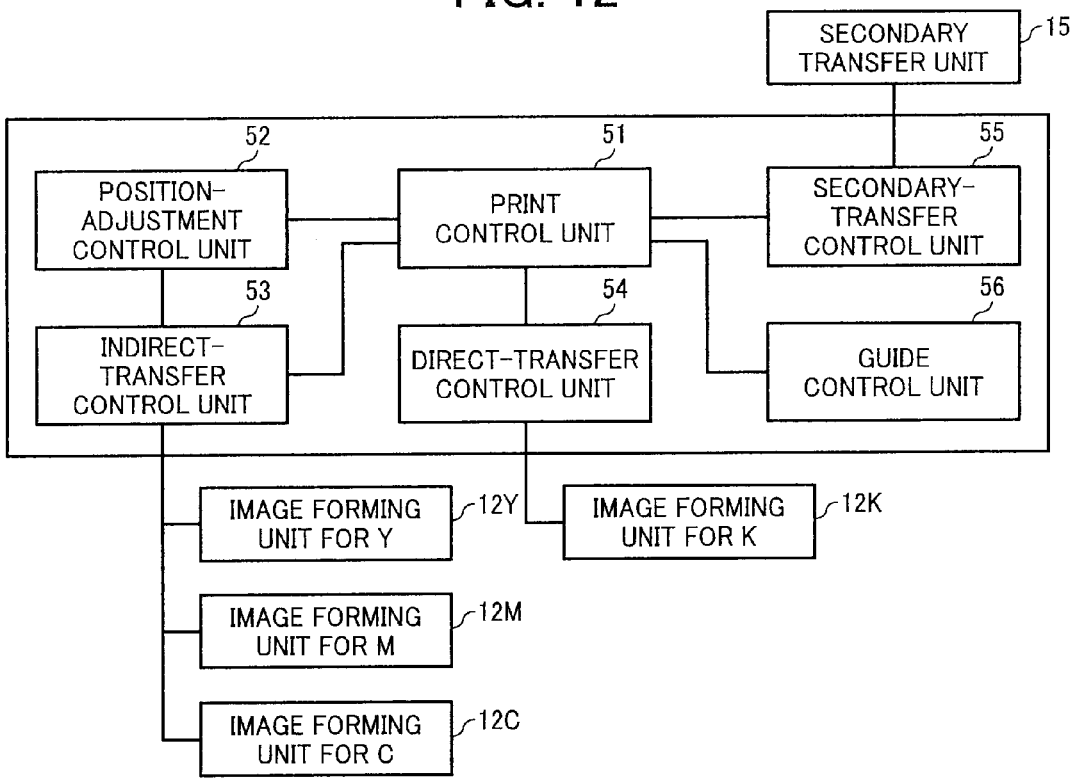
FIG. 12 is a block diagram of a functional configuration of the printer unit.

FIG. 12 is a block diagram of a functional configuration of the printer unit. The functional block diagram illustrated in FIG. 12 illustrates functions and means to be realized by executing the computer programs according to the embodiment. The printer unit 300 includes the print control unit 51, the position-adjustment control unit 52, the indirect-transfer control unit 53, the direct-transfer control unit 54, the secondary-transfer control unit 55, and the guide control unit 56 when the CPU 301 operates according to the computer programs.

The print control unit 51 controls the whole system (e.g., the position-adjustment control unit 52, the indirect-transfer control unit 53, the direct-transfer control unit 54, the secondary-transfer control unit 55, and the guide control unit 56) to perform full-color printing and monochrome printing.

When full-color printing is performed, the indirect-transfer control unit 53 controls the image forming units 12 (12Y, 12C, and 12M) for Y, C, and M colors and the intermediate transfer belt 6 to form an image to be transferred onto the transfer sheet P. More specifically, with the control by the indirect-transfer control unit 53, toner images for Y, M, and C, formed on the photosensitive elements 1 (1Y, 1C, and 1M) of the image forming units 12 (12Y, 12C, and 12M) respectively, are superimposed one on top of the other onto the intermediate transfer belt 6 by using the indirect transfer method. When the full-color printing is performed, the secondary-transfer control unit 55 controls the secondary transfer roller 28 of the secondary transfer unit 15 to bring it closer to the intermediate transfer belt 6 at a position where transfer to the transfer sheet P can be performed. Accordingly, Y-, M-, and C-color toner images, superimposed one on top of the other on the intermediate transfer belt 6 by using the indirect transfer method, are transferred onto the transfer sheet P at the position of the secondary transfer roller 28 of the secondary transfer unit 15.

Furthermore, the indirect-transfer control unit 53 controls the image forming units 12 (12Y, 12C, and 12M) for Y, C, and M colors and the intermediate transfer belt 6 to form images of the position-adjustment control patterns PT (see FIG. 13), which are used for position adjustment control by the position-adjustment control unit 52, on the intermediate transfer belt 6. When the pattern images for the position adjustment control are formed, because it is not necessary to transfer the toner images for Y, M, and C onto the transfer sheet P, the secondary-transfer control unit 55 separates the secondary transfer roller 28 of the secondary transfer unit 15 from the intermediate transfer belt 6.

The direct-transfer control unit 54 controls the image forming unit 12K for K color to form an image to be transferred onto the transfer sheet P when full-color printing and monochrome printing are performed. More specifically, with the control by the direct-transfer control unit 54, a toner image for K is formed on the photosensitive element 1K of the image forming unit 12K for K color. When monochrome printing is performed, because it is not necessary to transfer toner images for Y, M, and C onto the transfer sheet P, the secondary-transfer control unit 55 separates the secondary transfer roller 28 of the secondary transfer unit 15 from the intermediate transfer belt 6. Accordingly, the formed toner image for K is transferred onto the transfer sheet P at the position of the secondary transfer roller 28 of the secondary transfer unit 15 by using the direct transfer method. As described above, when the full-color printing is performed, the secondary-transfer control unit 55 controls the secondary transfer roller 28 of the secondary transfer unit 15 to bring it closer to the intermediate transfer belt 6 at a position where transfer to the transfer sheet P can be performed.

Figure 13:
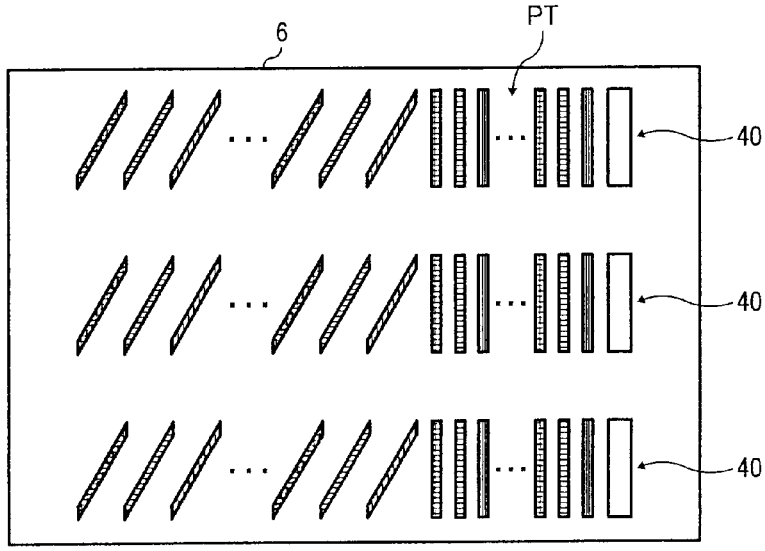
FIG. 13 is a plan view of exemplary position-adjustment control patterns PT.

The position-adjustment control unit 52 detects positional shift (color shift) between color images for respective colors, which are formed by the image forming units 12 (12Y, 12C, and 12M) for Y, C, and M colors and superimposed one on top of the other on the intermediate transfer belt 6 controlled by the indirect-transfer control unit 53, and calculates a correction amount. In the position adjustment control, to detect the amount of shift between each color, the position-adjustment control patterns PT illustrated in FIG. 13 are formed on the intermediate transfer belt 6. FIG. 13 is a plan view of an example of the position-adjustment control patterns PT. As illustrated in FIG. 13, each of the position-adjustment control patterns PT contains three parallel patterns and three oblique line patterns arranged at predetermined intervals in the sub-scanning direction. Such a position-adjustment control pattern PT is repeatedly formed along a moving direction of the intermediate transfer belt 6. The three patterns constituting the position-adjustment control pattern PT is formed for three colors of yellow (Y), cyan (C), and magenta (M), respectively. To increase the number of samples and to thereby reduce the influence of errors, a plurality of the position-adjustment control patterns PT are output according to respective positions of the pattern detection sensors 40 as illustrated in FIG. 13.

Figure 14:
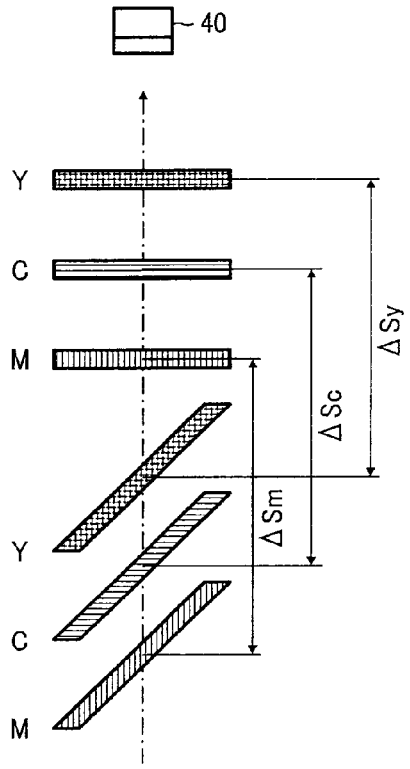
FIG. 14 is a diagram illustrating an example of calculating a main-scanning shift amount.
Figure 15:
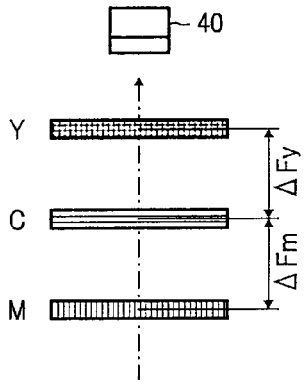
FIG. 15 is a diagram illustrating an example of calculating a sub-scanning shift amount.

Conventionally, a number of correction-amount calculation methods and position-adjustment control methods performed by the position-adjustment control unit 52 have been proposed. An example of calculation of the amount of positional shift is described with reference to FIGS. 14 and 15. FIG. 14 illustrates an example of calculation of a main-scanning shift amount, and FIG. 15 illustrates an example of calculation of a sub-scanning shift amount. As illustrated in FIG. 14, the main-scanning shift amount is calculated by counting time for lengths of horizontal lines and oblique lines ($\Delta Sc$, $\Delta Sy$, $\Delta Sm$) for each color by a timer of the CPU 101, converting the time into the lengths, and comparing the lengths with each other. On the other hand, as illustrated in FIG. 15, the sub-scanning shift amount is calculated by counting time for lengths ($\Delta Fy$, $\Delta Fm$) from a reference color (in this example, C) by the timer of the CPU 101, converting the time into the lengths, and comparing the lengths with an ideal length. As described above, the amount of shift from an ideal distance is calculated for each color, and the amount is fed back to each of the image forming units 12 (12Y, 12C, and 12M) for Y, C, and M colors to correct the positional shift (color shift).

When the print control unit 51 receives a print request from the controller 11C, the guide control unit 56 performs control to change the angel between the transfer sheet P and the contact surface 11*a* based on a predetermined condition, such as a thickness of the transfer sheet P, a type of the transfer sheet P, a conveying speed of the transfer sheet P, humidity inside the color digital MFP 100, and temperature inside the color digital MFP 100. Such conditions influence the way of skew of the transfer sheet P that has passed through the secondary transfer unit 15, and influence a moving direction of the transfer sheet P after the transfer sheet P comes into contact with the contact surface 11*a*. The way of skew of the transfer sheet P that has passed through the secondary transfer unit 15 depends on the hardness of the transfer sheet P and the conveying speed of the transfer sheet P. Furthermore, the moving direction of the transfer sheet P after the transfer sheet P comes into contact with the guide member 11 depends on the hardness of the transfer sheet P and friction between the transfer sheet P and the contact surface 11*a*. Therefore, when the way of skew of the transfer sheet P and the moving direction of the transfer sheet P may vary because of the predetermined condition, the guide control unit 56 performs control to change the angle between the transfer sheet P and the contact surface 11*a* depending on the predetermined condition.

Figure 16:
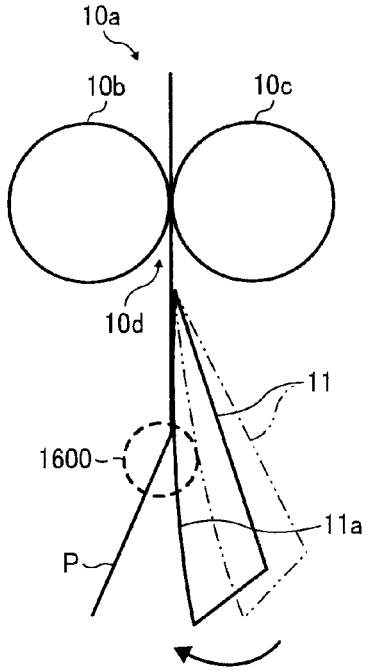
FIG. 16 is a diagram for explaining a function of the guide member and control of an angle between a transfer sheet and a contact surface of the transfer sheet.

FIG. 16 is a diagram for explaining a function of the guide member and the control of the angle between the transfer sheet and the contact surface. When the transfer sheet P is a cardboard, because the hardness of the transfer sheet P is high, the transfer sheet P can be guided to the nip portion 10*d* of the fixing roller pair 10*a* even when the transfer sheet P is not guided to the nip portion 10*d* by a contact angle (illustrated in FIG. 9) between the edge of the contact surface 11*a* on the fixing roller pair 10*a* side and the transfer sheet P. Therefore, when the hardness of the transfer sheet P is high, the guide control unit 56 moves the guide member 11 in a direction indicated by an arrow of FIG. 16 to narrow the angle between the transfer sheet P and the contact surface 11*a* at a contact portion 1600 where the transfer sheet P and the contact surface 11*a* come into contact with each other. Consequently, occurrence of the shock jitter due to the contact between the transfer sheet P and the fixing roller pair 10*a* can be prevented and shock due to the contact between the guide member 11 and the transfer sheet P can also be reduced.

On the other hand, when the transfer sheet P is a thin paper, because the hardness of the transfer sheet P is low, the guide control unit 56 cannot guide the transfer sheet P to the nip portion 10*d* of the fixing roller pair 10*a* unless the guide control unit 56 guides the transfer sheet P to the nip portion 10*d* by the contact angle (see FIG. 9) between the edge of the contact surface 11*a* on the fixing roller pair 10*a* side and the transfer sheet P. Therefore, when the hardness of the transfer sheet P is low, the guide control unit 56 moves the guide member 11 in a direction opposite to the direction indicated by the arrow illustrated in FIG. 16 to widen the angle between the transfer sheet P and the contact surface 11*a* at the contact portion 1600. Accordingly, the transfer sheet P can be guided to the nip portion 10*d* by the contact angle (see FIG. 9) between the edge of the contact surface 11*a* on the fixing roller pair 10*a* side and the transfer sheet P. Therefore, occurrence of the shock jitter due to the contact between the transfer sheet P and the fixing roller pair 10*a* can be prevented.

Regarding the other predetermined conditions such as the type of the transfer sheet P, the conveying speed of the transfer sheet P, the humidity inside the color digital MFP 100, and the temperature inside the color digital MFP 100, the guide control unit 56 controls the angle between the transfer sheet P and the contact surface 11*a* in the same manner as it does according to the thickness of the transfer sheet P. For example, when the type of the transfer sheet P is a hard sheet, the guide control unit 56 narrows the angle between the transfer sheet P and the contact surface 11*a*; and when the type of the transfer sheet P is a soft sheet, the guide control unit 56 widens the angle between the transfer sheet P and the contact surface 11*a*. Furthermore, when the conveying speed of the transfer sheet P is fast, the guide control unit 56 narrows angle between the transfer sheet P and the contact surface 11*a*; and, when the conveying speed of the transfer sheet P is slow, the guide control unit 56 widens the angle between the transfer sheet P and the contact surface 11*a*. Moreover, when the humidity inside the color digital MFP 100 is high, the guide control unit 56 widens the angle between the transfer sheet P and the contact surface 11*a*; and, when the humidity inside the color digital MFP 100 is low, the guide control unit 56 narrows the angle between the transfer sheet P and the contact surface 11*a*. Furthermore, when the temperature inside the color digital MFP 100 is high, the guide control unit 56 widens the angle between the transfer sheet P and the contact surface 11*a*; and, when the temperature inside the color digital MFP 100 is low, the guide control unit 56 narrows the angle between the transfer sheet P and the contact surface 11*a*. In this manner, the angle between the transfer sheet P and the contact surface 11*a* is controlled depending on the predetermined condition such as the thickness of the transfer sheet P, the type of the transfer sheet P, the conveying speed of the transfer sheet P, the humidity inside the color digital MFP 100, and the temperature inside the color digital MFP 100, so that the transfer sheet P can be guided to the nip portion 10*d* without causing the shock jitter. It is also possible to control the angle between the transfer sheet P and the contact surface 11*a* depending on a combination of any of the thickness of the transfer sheet P, the type of the transfer sheet P, the conveying speed of the transfer sheet P, the humidity inside the color digital MFP 100, and the temperature inside the color digital MFP 100.

Figure 17:
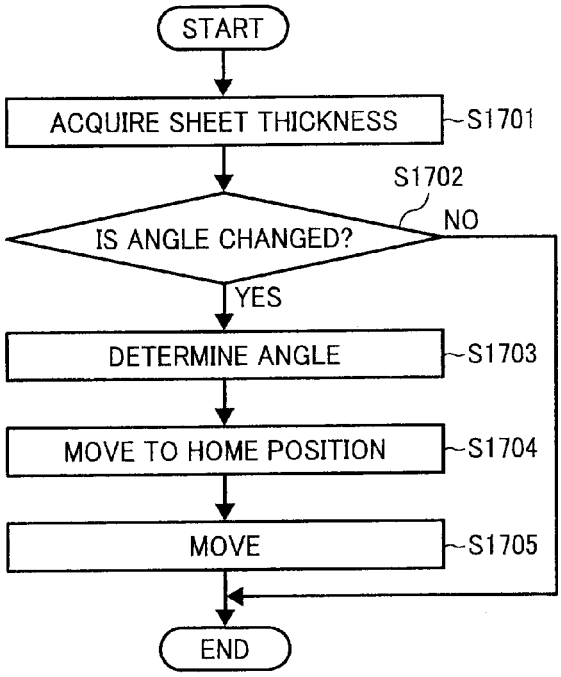
FIG. 17 is a flowchart of a process procedure for controlling the angle between the transfer sheet and the contact surface depending on a thickness of the transfer sheet.

A procedure of a process for controlling the angle between the transfer sheet P and the contact surface 11*a* depending on the thickness of the transfer sheet P is described below with reference to FIG. 17. FIG. 17 is a flowchart of a process procedure for controlling the angle between the transfer sheet and the contact surface depending on the thickness of the transfer sheet.

When the print control unit 51 receives a print request from the controller 11C, the guide control unit 56 acquires a thickness data of the transfer sheet P conveyed from the sheet feed tray 22 or the sheet feed tray 23 to the printer unit 300 (Step S1701). It is assumed that the thickness of the transfer sheet P is set in advance for each of the sheet feed trays 22 and 23.

Then, the guide control unit 56 determines whether to change the angle between the transfer sheet P and the contact surface 11*a* according to the acquired thickness of the transfer sheet P (Step S1702). In the embodiment, it is assumed that a table, in which thicknesses of the transfer sheet P and angles between the transfer sheet P and the contact surface 11*a* depending on the respective thicknesses of the transfer sheet P are associated with each other, is stored in a storage means such as the ROM 303. It is also assumed that a flag is assigned to the current angle between the transfer sheet P and the contact surface 11*a*, and the guide control unit 56 determines whether an angle associated with the acquired thickness of the transfer sheet P and the angle assigned with the flag are identical to each other. When the angle associated with the acquired thickness data of the transfer sheet P and the angle assigned with the flag are identical to each other, the guide control unit 56 determines not to change the angle (NO at Step S1702).

On the other hand, when determining to change the angle (YES at Step S1702), the guide control unit 56 determines the angle associated with the acquired thickness data of the transfer sheet to be an angle between the transfer sheet P and the contact surface 11*a* (Step S1703). Then, when the homing sensor 13 confirms that the guide member 11 moves to the home position (Step S1704), the guide control unit 56 rotates the DC motor 14 to rotate the rotation axis 11*b* to thereby move the guide member 11 so that the angle between the transfer sheet P and the contact surface 11*a* is set to the determined angle (Step S1705).

In FIG. 17, an example is described in which the angle between the transfer sheet P and the contact surface 11*a* is controlled depending on the thickness of the transfer sheet P.

However, when the angle between the transfer sheet P and the contact surface 11*a* is controlled depending on the type of the transfer sheet P, the conveying speed of the transfer sheet P, the humidity inside the color digital MFP 100, and the temperature inside the color digital MFP 100, the same operation can be applied.

As described above, according to the color digital MFP 100 of the embodiment, the guide member 11 for guiding the transfer sheet P to the nip portion 10*d* of the fixing roller pair 10*a* is provided on a path where the transfer sheet P is conveyed substantially vertically up from the secondary transfer unit 15 to reach the nip portion 10*d*. Therefore, impact of the shock jitter that occurs when the transfer sheet P enters into the fixing device 10 can be reduced. As a result, it is possible to prevent a color shift between the toner images formed by the image forming units 12Y, 12C, and 12M and the toner image directly transferred onto the transfer sheet P by the image forming unit 12K.

According to an embodiment of the present invention, it is possible to prevent color shift between an image transferred onto a transfer sheet by using an indirect transfer method and an image transferred onto the transfer sheet by using a direct transfer method.

The present invention is not limited to the exemplary embodiments described above. At the implementation stage of the invention, it is possible to materialize the present invention while applying modifications to the constituent elements thereof without departing from the scope of the present invention. In addition, it is possible to form various inventions by combining, as necessary, two or more of the constituent elements disclosed in the exemplary embodiments. For example, it is acceptable to omit some of the constituent elements described in the exemplary embodiments. Furthermore, it is acceptable to combine, as necessary, the constituent elements from mutually different ones of the exemplary embodiments.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first image forming unit configured to directly transfer an image onto a transfer sheet being conveyed;

an intermediate transfer member onto which an image to be additionally transferred onto the transfer sheet is transferred;

a secondary image forming unit configured to transfer an image onto the intermediate transfer member;

a secondary transfer unit configured to transfer the image, already transferred on the intermediate transfer member by the secondary image forming unit, onto the transfer sheet, on which the image directly transferred by the first image forming unit is transferred;

a fixing unit:

that is provided downstream of the secondary transfer unit in a vertical conveying direction of the transfer sheet on a vertical conveying path of the transfer sheet, and that is configured to fix an image formed on the transfer sheet at a fixation position where the fixing unit comes into contact with the transfer sheet and apply pressure to the transfer sheet;

a guide member configured to guide the transfer sheet to the fixation position on the vertical conveying path where the transfer sheet is conveyed from the secondary transfer unit to the fixation position, the guide member including:

a contact surface, which is a side surface of the guide member, the contact surface being in contact with the transfer sheet on the vertical conveying path where the transfer sheet is conveyed vertically from the secondary transfer unit to the fixation position, and a rotation axis fixed to an upper portion of the guide member that is configured to be able to change an angle between the transfer sheet and the contact surface by rotating the guide member, the rotation axis extending through the guide member proximate to a point of the guide member closest to the fixation position;

a sensor configured to detect a home position of the guide member as a position to be a basis for changing the angle between the transfer sheet and the contact surface; and a control unit configured to obtain a predetermined condition of the transfer sheet and information on the home position of the guide member from the sensor, and drive the rotating of the guide member by the rotation axis to set the angle between the transfer sheet and the contact surface based on the predetermined condition of the transfer sheet and the information on the home position of the guide member.

2. The image forming apparatus according to claim 1, wherein the predetermined condition changes:

a way of skew of the transfer sheet that has passed through the secondary transfer unit, and a moving direction of the transfer sheet after the transfer sheet comes into contact with the contact surface.

3. The image forming apparatus according to claim 2, wherein the predetermined condition is a thickness of the transfer sheet.

4. The image forming apparatus according to claim 2, wherein the predetermined condition is a type of the transfer sheet.

5. The image forming apparatus according to claim 2, wherein the predetermined condition is a conveying speed of the transfer sheet.

6. The image forming apparatus according to claim 2, wherein the predetermined condition is humidity inside the image forming apparatus.

7. The image forming apparatus according to claim 2, wherein the predetermined condition is temperature inside the image forming apparatus.

8. The image forming apparatus according to claim 2, wherein the control unit performs control to change the angle depending on a combination of any of predetermined conditions among: a thickness of the transfer sheet, a type of the transfer sheet, a conveying speed of the transfer sheet, humidity inside the image forming apparatus, and temperature inside the image forming apparatus.

9. The image forming apparatus according to claim 1, wherein the contact surface of the guide member is curved.

10. The image forming apparatus according to claim 9, wherein the contact surface of the guide member is convex.

11. The image forming apparatus according to claim 1, wherein the guide member has a wedge-shaped cross-section, the guide member includes relatively thin and thick ends at distal portions thereof, such that the point of the guide member closest to the fixation position is the thin end, and the guide member is arranged so that the thick end and the thin end are arranged in this order with respect to a downstream direction feeding of the transfer sheet.

12. The image forming apparatus according to claim 11, wherein the rotation axis is fixed to the guide member at the thin end, such that the rotating causes the thick end to have a rotational path that is larger than a rotational path of the thin end.

13. The image forming apparatus according to claim 1, wherein the control unit is configured to drive a motor to drive the rotating of the guide member by the rotation axis.

14. The image forming apparatus according to claim 1, wherein:

the control unit includes circuitry that is configured to obtain the predetermined condition of the transfer sheet and the information on the home position of the guide member from the sensor, and the circuitry is configured to drive a motor to drive the rotating of the guide member by the rotation axis.

15. An image forming method executed in an image forming apparatus that includes:

a first image forming unit configured to directly transfer an image onto a transfer sheet being conveyed;

an intermediate transfer member onto which an image to be additionally transferred onto the transfer sheet is transferred;

a secondary image forming unit configured to transfer an image onto the intermediate transfer member;

a secondary transfer unit configured to transfer the image, already transferred on the intermediate transfer member by the secondary image forming unit, onto the transfer sheet, on which the image directly transferred by the first image forming unit is transferred;

a fixing unit:

that is provided downstream of the secondary transfer unit in a vertical conveying direction of the transfer sheet on a vertical conveying path of the transfer sheet, and that is configured to fix an image formed on the transfer sheet at a fixation position where the fixing unit comes into contact with the transfer sheet and apply pressure to the transfer sheet;

a guide member configured to guide the transfer sheet to the fixation position on the vertical conveying path where the transfer sheet is conveyed from the secondary transfer unit to the fixation position, the guide member including:

a contact surface, which is a side surface of the guide member, the contact surface being in contact with the transfer sheet on the vertical conveying path where the transfer sheet is conveyed vertically from the secondary transfer unit to the fixation position, and a rotation axis fixed to an upper portion of the guide member that is configured to be able to change an angle between the transfer sheet and the contact surface by rotating the guide member, the rotation axis extending through the guide member proximate to a point of the guide member closest to the fixation position;

a sensor configured to detect a home position of the guide member as a position to be a basis for changing the angle between the transfer sheet and the contact surface; and a control unit configured to obtain a predetermined condition of the transfer sheet and information on the home position of the guide member from the sensor, and drive the rotating of the guide member by the rotation axis to set the angle between the transfer sheet and the contact surface based on the predetermined condition of the transfer sheet and the information on the home position of the guide member, the image forming method comprising:

performing, by the control unit of the image forming apparatus, control to change the angle depending on the predetermined condition that changes:

a way of skew of the transfer sheet that has passed through the secondary transfer unit, and a moving direction of the transfer sheet after the transfer sheet comes into contact with the contact surface.

16. A computer program product comprising a computer usable medium having computer-readable program codes embodied in the medium for controlling an image forming apparatus that includes:

a first image forming unit configured to directly transfer an image onto a transfer sheet being conveyed;

an intermediate transfer member onto which an image to be additionally transferred onto the transfer sheet is transferred;

a secondary image forming unit configured to transfer an image onto the intermediate transfer member;

a secondary transfer unit configured to transfer the image, already transferred on the intermediate transfer member by the secondary image forming unit, onto the transfer sheet, on which the image directly transferred by the first image forming unit is transferred;

a fixing unit:

that is provided downstream of the secondary transfer unit in a vertical conveying direction of the transfer sheet on a vertical conveying path of the transfer sheet, and that is configured to fix an image formed on the transfer sheet at a fixation position where the fixing unit comes into contact with the transfer sheet and apply pressure to the transfer sheet; and a guide member configured to guide the transfer sheet to the fixation position on the vertical conveying path where the transfer sheet is conveyed from the secondary transfer unit to the fixation position, the guide member including:

a contact surface, which is a side surface of the guide member, the contact surface being in contact with the transfer sheet on the vertical conveying path where the transfer sheet is conveyed vertically from the secondary transfer unit to the fixation position, and a rotation axis fixed to an upper portion of the guide member that is configured to be able to change an angle between the transfer sheet and the contact surface by rotating the guide member, the rotation axis extending through the guide member proximate to a point of the guide member closest to the fixation position;

a sensor configured to detect a home position of the guide member as a position to be a basis for changing the angle between the transfer sheet and the contact surface; and a control unit configured to obtain a predetermined condition of the transfer sheet and information on the home position of the guide member from the sensor, and drive the rotating of the guide member by the rotation axis to set the angle between the transfer sheet and the contact surface based on the predetermined condition of the transfer sheet and the information on the home position of the guide member, the program codes when executed causing a computer to execute:

performing, by the control unit of the image forming apparatus, control to change the angle based on the predetermined condition that changes:

a way of skew of the transfer sheet that has passed through the secondary transfer unit and a moving direction of the transfer sheet after the transfer sheet comes into contact with the contact surface.

* * * * *